US007033226B1

(12) United States Patent
Chien et al.

(10) Patent No.: US 7,033,226 B1
(45) Date of Patent: Apr. 25, 2006

(54) AUDIO RECEPTACLE CONNECTOR

(75) Inventors: Min-Ling Chien, Taipei (TW); Kai-Ray Cheng, Taipei (TW); Jian Cheng, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/138,284

(22) Filed: May 27, 2005

(30) Foreign Application Priority Data

Jan. 14, 2005 (TW) ..... 94200759 U

(51) Int. Cl.
*H01R 24/04* (2006.01)

(52) U.S. Cl. ..... 439/668

(58) Field of Classification Search ..... 439/668
See application file for complete search history.

(56) References Cited

U.S. PATENT DOCUMENTS 6,346,013 B1 2/2002 Zhang et al.
6,368,156 B1 4/2002 Lin
6,568,963 B1 * 5/2003 Zhang et al. ..... 439/668

* cited by examiner

*Primary Examiner*—Tho D. Ta
(74) *Attorney, Agent, or Firm*—Troxell Law Office, PLLC

(57) ABSTRACT

Provided is an improved audio receptacle connector such as one mounted in a mobile communication product. The audio receptacle connector improves the conventional SMT terminals as compression type terminals in order to achieve a perfect connection to a PCB. A mobile communication product can have improved communication quality by incorporating the audio receptacle connector thereinto.

2 Claims, 3 Drawing Sheets

AUDIO RECEPTACLE CONNECTOR

BACKGROUND OF THE INVENTION

1. Field of the Invention

The present invention relates to audio receptacle connectors, and more particularly to an audio receptacle connector having compression type terminals adapted to mate with an audio plug for audio signal transmission.

2. Description of Related Art

Audio receptacle connectors have been widely employed in audio-visual products. Their primary function is to transmit audio signal between two systems. In recent years, a wide variety of portable electrical products (e.g., mobile phones, PDA, MP3s, laptop computers, etc.) are available. Thus, application of the audio receptacle connectors in these products becomes more important. Each electrical product has its own exclusively applicable audio receptacle connector. For such products, please refer to U.S. Pat. Nos. 6,346,013 and 6,368,156. The conventional audio receptacle connectors are soldered to the printed circuit board (PCB) via through-holes or mounted on the PCB by surface mounting (SMT). However, it is not appropriate for a portable electrical product having limited internal space or a small PCB. On the other hand, generally speaking, most of the construction of SMT connector terminals are relatively complex and need several stamping processes to produce. And in turn, it needs several sets of relatively complex molds in the manufacturing process, resulting in an increase of the production cost. Further, in the known SMT audio connectors, the fastening of the grounding terminal and the insulative housing is still done by the known through-hole soldering connectors. That is, engage with each other by snapping the snapping hole on the terminal with the convex piece on the housing. However, such fastening is not reliable. As a result, it is easy to disengage in response to collision. Moreover, the fastening can increase the consumption of materials of terminal and insulative housing. And in turn, the manufacturing cost is increased significantly.

In addition, the product applied in a different environment has a different requirement about the insertion force of the receptacle connector, especially, in the portable devices. Thus, a factor of applying the product in different environment must be considered since the required insertion force is not the same. In the above-mentioned SMT terminal construction, the required insertion force for the mating receptacle connector is evenly shared by the terminals. If the insertion force increases or decreases, the molds must be redesigned or reselect materials, resulting in a further increase of the manufacturing cost.

Moreover, the known audio receptacle connector has a single diameter. After many times of insertion the terminals are easy to wear and their resilience may degrade significantly. This is because the body of the audio plug rubs the terminals repeatedly. Thus, it is desirable to provide an improved audio receptacle connector in order to overcome the inadequacies of the prior art.

SUMMARY OF THE INVENTION

For overcoming the inadequacies of the prior audio receptacle connector, the present invention provides an improved audio receptacle connector adapted to connect to a PCB through its compression type terminals.

An object of the present invention is to provide an improved construction of the audio receptacle connector by forming terminals of the connector as compression type. The compression type terminals are adapted to easily connect to the PCB. The present invention can carry out a convenient component replacement and significantly reduce the manufacturing cost.

Another object of the present invention is to provide an improved construction of the audio receptacle connector in which its compression type terminals are formed to bend laterally in an angle and extend outward from the body portion of the terminal so as to reduce space occupied by the connector on the PCB.

To achieve the above and other objects, the present invention provides an audio receptacle connector comprising an insulative housing of being substantially parallelepiped comprising a body portion, a mating portion extended along an axis of the body portion, an insertion hole disposed on the mating portion, a plurality of terminal grooves on a bottom surface of the body portion, and a plurality of slots on a rear of the terminal grooves; and a terminal assembly comprising a plurality of pairs of terminals, a grounding terminal, and a receiving terminal; wherein solder legs of the terminal assembly are flexibly compressible, wherein each terminal has a compression portion bent and extended outward from a bottom of the terminal, and wherein a contact portion is formed at an end of the compression portion for contacting a PCB.

In one aspect of the present invention the plurality of terminals are placed in the predetermined holes of the insulative housing in which each terminal has a compression portion for flexibly compressing itself onto the PCB for electrical connection.

In another aspect of the present invention, the audio receptacle connector further comprises a grounding terminal and a receiving terminal in which the grounding terminal is adapted to shield EMI (electromagnetic interference) and rub in between the receiving terminal and the audio plug for fastening the audio plug in the audio receptacle connector. Further, it is possible of obtaining different insertion forces by varying the shape of the receiving terminal so as to improve quality and enhance functionality of the audio receptacle connector.

The above and other objects, features and advantages of the present invention will become apparent from the following detailed description taken with the accompanying drawings.

DETAILED DESCRIPTION OF THE INVENTION

Figure 1:
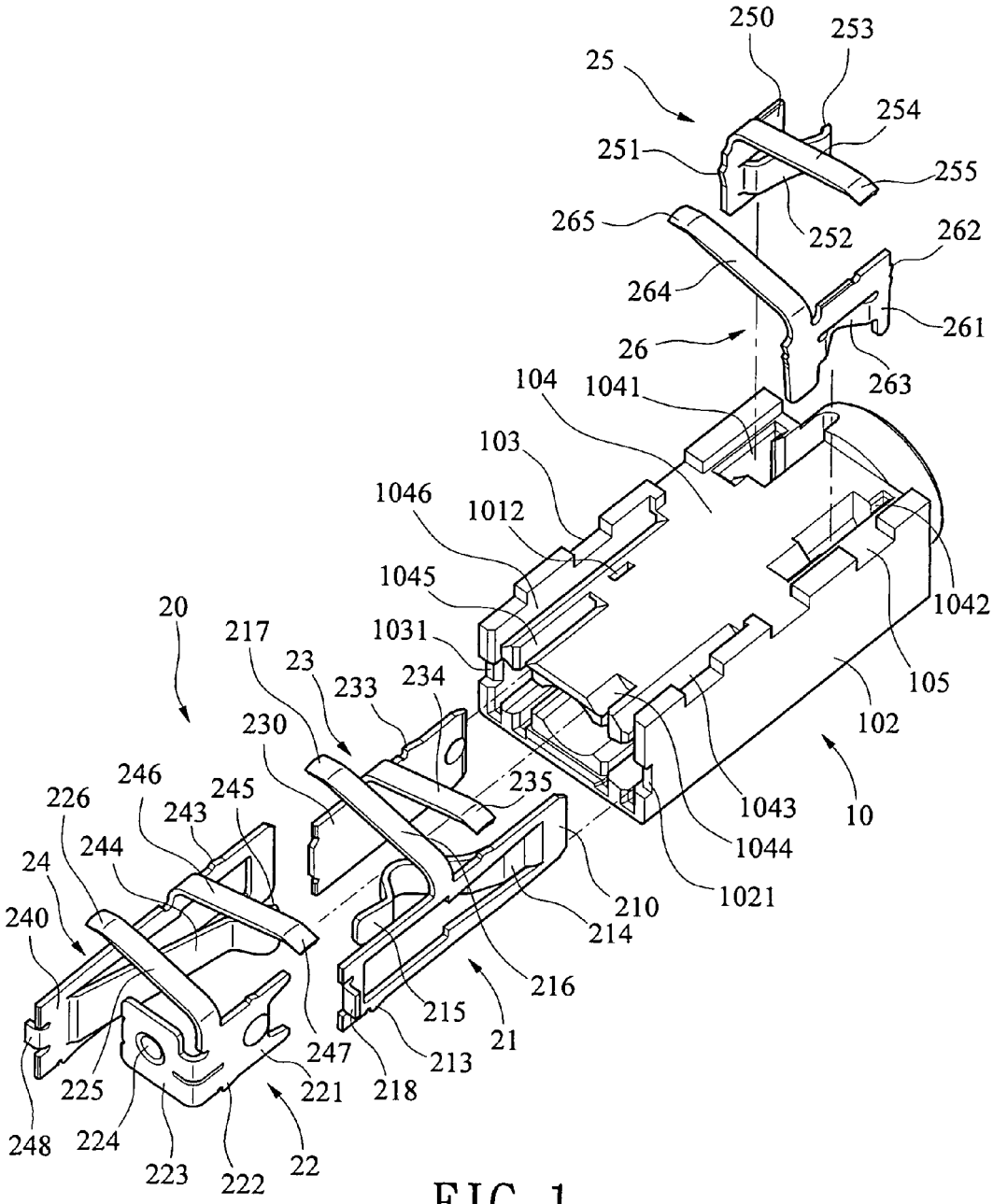
FIG. 1 is an exploded perspective view of a preferred embodiment of audio receptacle connector according to the present invention.
Figure 2:
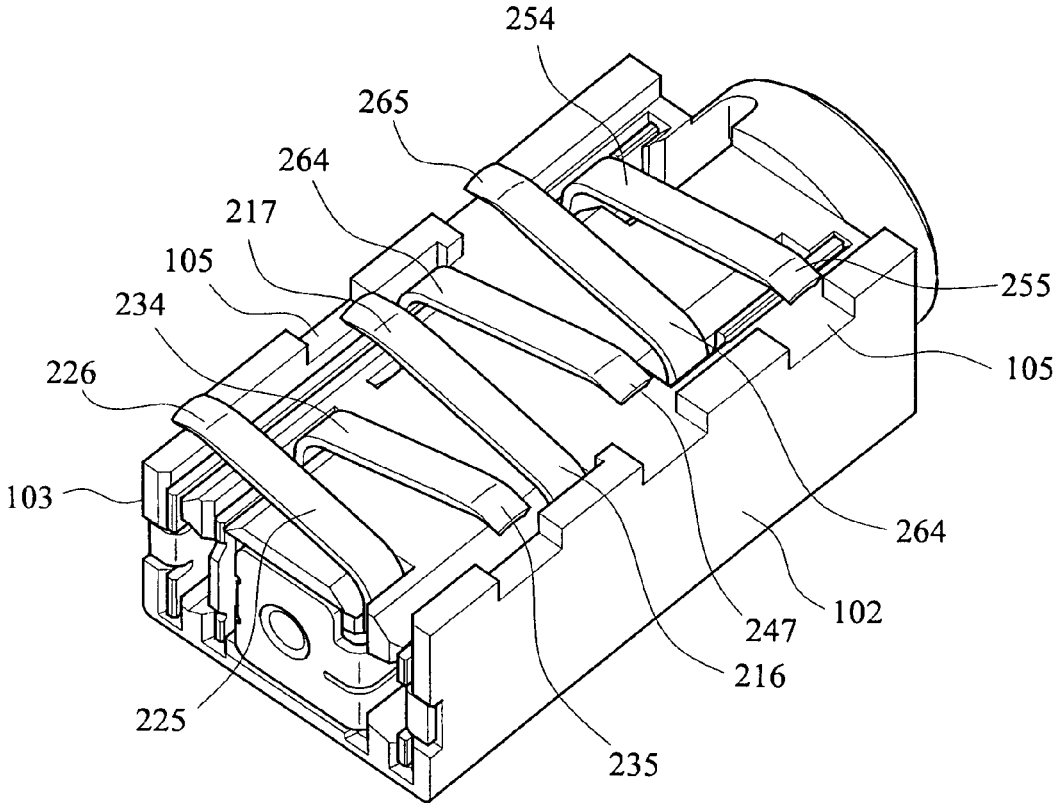
FIG. 2 is a perspective view of the assembled audio receptacle connector shown in FIG. 1.
Figure 3:
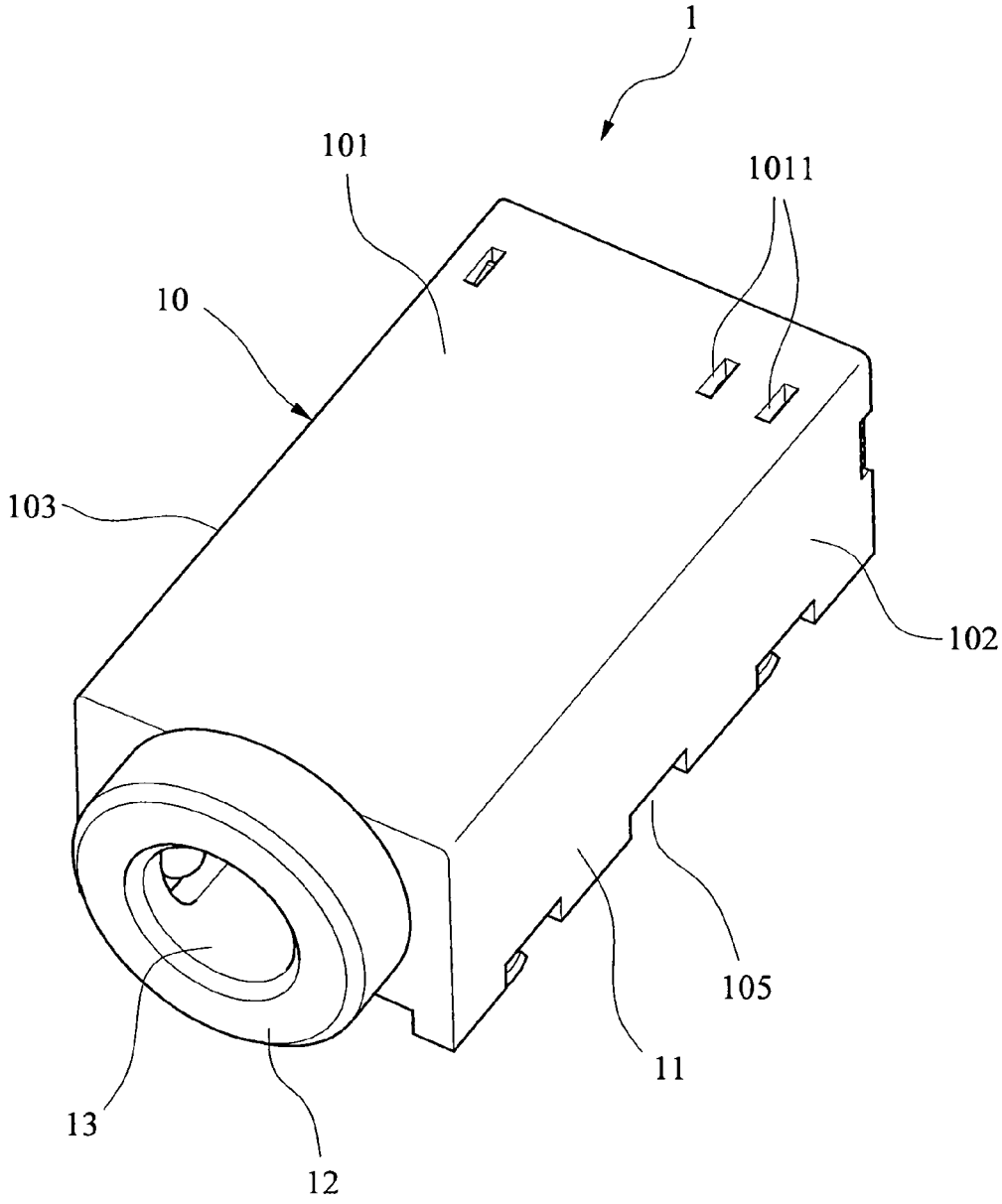
FIG. 3 is another perspective view of FIG. 2.

Referring to FIGS. 1, 2, and 3, an audio receptacle connector 1 constructed according to a preferred embodiment of the present invention is shown. The audio receptacle connector 1 comprises an insulative housing 10 and a terminal assembly 20. The insulative housing 10 is approximately a rectangular body including a body portion 11 and a mating portion 12 extended along an axial direction of the body portion 11 from one side of the insulative housing 10. On the mating portion 12 there is provided an insertion hole 13 passed through the body portion 11 and the mating portion 12. The body portion 11 has a top surface 101, a first sidewall 102, a second sidewall 103, and a bottom surface 104. On the rear end of the top surface 101 there are provided a plurality of snapping holes 1011 adapted to engage with the convex spurs disposed on the top portion of the terminals. On both sides of the bottom surface 104 there are provided a plurality of notches 105 as predetermined electrical circuit on the PCB contacted each compression portion of the terminals. On the bottom surface 104 of the body portion 11 there are provided a plurality of terminal grooves. In the front of the bottom surface 104 there are provided first and second terminal grooves 1041 and 1042 for permitting the grounding terminal 25 and the receiving terminal 26 to insert vertically. On the rear end of the body portion 11 adjacent the first sidewall 102 there are provided a first slot 1043 and a second slot 1044. Adjacent to the second sidewall 103 there are provided a third slot 1045 and a fourth slot 1046. The first and the second slots 1043 and 1044 serve as the retaining grooves for the first flexible terminal 21 and the first cooperating terminal 22. The third and the fourth slots 1045 and 1046 serve as the retaining grooves for the second flexible terminal 23 and the second cooperating terminal 24. In the front of the third slot 1045 there is provided a snapping hole 1012.

The terminal assembly 20 comprises a first flexible terminal 21, a first cooperating terminal 22, a second flexible terminal 23, a second cooperating terminal 24, a grounding terminal 25, and a receiving terminal 26. The grounding terminal 25 and the receiving terminal 26 are vertical insertion terminals. The first flexible terminal 21 and the first cooperating terminal 22 together form a pair of switch terminals. The second flexible terminal 23 and the second cooperating terminal 24 together form another pair of switch terminals.

The first flexible terminal 21 employs a vertical plate as its main portion 210. On upper and lower ends of the main portion 210 each has a convex spur 213 for fastening the terminal. On the main portion 210 there are provided a laterally projected flexible arm 214 served as a contact with the audio plug. The flexible arm 214 is convex shape. On a distal end of the flexible arm 214 there are provided a contact portion 215 adapted to contact the first cooperation terminal 22. On a bottom surface of the main portion 210 there are provided a compression portion 216 laterally bent with respect to the main portion 210. On a distal end of the compression portion 216 there is provided an arched contact portion 217. On a rear end of the main portion 210 there is further provided a lateral bent portion 218 adapted to engage with the snapping groove 1021 on the first sidewall 102 of the insulative housing 10. The first cooperation terminal 22 is bent and a straight portion thereof is formed as a snapping portion 221. On upper and lower ends of the snapping portion 221 each is provided with a convex spur 222 for fastening. Snapping portion 221 also serves as a contact with the first flexible terminal 21. The lateral portion is formed as a stop piece 223 on which there is provided a concave hole 224 adapted to abut head of the audio plug for enhancing the fastening. On bottom surface of the snapping portion 221 there is provided a compression portion 225 laterally bent about the snapping portion 221. On a distal end of the compression portion 225 there is provided an arched contact portion 226.

The second flexible terminal 24 employs a vertical plate as its main portion 240. On upper and lower ends of the main portion 240 each has a convex spur 243 for fastening the terminal. On the main portion 240 there is further provided a laterally projected flexible arm 244 as a contact with the audio plug. The flexible arm 244 extends outward from a rear end of the main portion 240. On a rear end of the flexible arm 244 there is provided a contact portion 245 adapted to contact the second cooperation terminal 24. On a bottom surface of the main portion 240 there is further provided a compression portion 245 laterally bent with respect to the main portion 240. On a distal end of the compression portion 246 there is provided an arched contact portion 247. On a rear end of the main portion 240 there is also provided a lateral bent portion 248 adapted to engage with the snapping groove 1031 disposed on the second sidewall 103. The second cooperation terminal 23 also employs a vertical plate as main portion 230. On upper and lower ends of the main portion 230 each has a convex spur 233 also for fastening. On bottom surface of the main portion 230 there is provided a laterally bent compression portion 234. On a distal end of the compression portion 234 there is provided an arched contact portion 235.

The grounding terminal 25 is placed in the first terminal groove 1041 in the front of the insulative housing 10. A base of the grounding terminal 25 is formed as a vertical main portion 250. On both sides of the main portion 250 each is provided a convex spur 251 for fastening. On a middle of the main portion 250 a flexible arm 252 is extended. On a distal end of the flexible arm 252 there is provided a slightly bent contact portion 253. On bottom of the main portion 250 there is also provided a laterally bent compression portion 254. A distal end of the compression portion 254 there is provided an arched contact portion 255.

The receiving terminal 26 is placed in the second terminal groove 1042 in the front of the insulative housing 10. The receiving terminal 26 is formed as a vertical plate. The vertical portion is formed as a fastening portion 261. On both sides of the fastening portion 261 each has a convex spur 262 for fastening. On a middle of the fastening portion 261 there is provided a contact portion 263 having a concave shape for contacting the audio plug. On a bottom of the fastening portion 264 there is provided a laterally bent compression portion 264. On a distal end of the compression portion 264 there is provided an arched contact portion 265.

In the present invention all terminals are flexibly compressed and are bent laterally and extended outward from bottom of the respective main portions. On a distal end of the terminal there is provided a compression portion adapted to connect the PCB.

Prior terminal solder legs of such receptacle connector are formed mainly by means of SMT or through-hole with the terminal solder legs soldered directly onto the PCB or via through-holes drilled on the PCB. Such is inconvenient in assembly. In contrast, the terminals of the present receptacle connector contact the PCB in a compression type. Therefore, the present invention can substantially eliminate defects associated with securing the receptacle connector onto the PCB in the prior art.

The assembly of the present invention is very simple. First, vertically insert the grounding terminal 25 and the receiving terminal 26 from the bottom surface 104 of the insulative housing 10 into the first terminal groove 1041 and the second terminal groove 1042 respectively. Next, engage the convex spurs 251 and 262 on the grounding terminal 25 and the receiving terminal 26 respectively with the terminal grooves. The contact portion 263 of the receiving terminal 26 is disposed in the insertion hole passed the insulative housing 10 to rub the audio plug for providing a relatively strong insertion force. Further, it is possible of controlling the rub and contact extent between the audio plug 40 and the receiving terminal 26 by varying height projected inward from the contact portion in order to obtain a different insertion force. Then respectively insert the first flexible terminal 21 and the first cooperation terminal 22 toward a front direction into the corresponding first and second slots 1043 and 1044. The second cooperation terminal 23 and the second flexible terminal 24 are inserted respectively into the corresponding third and fourth slots 1045 and 1046. Dispose the spurs 213, 222 and 243 on main portions of the first flexible terminal 21, the first cooperation terminal 22, and the second flexible terminal 24 respectively so as to engage with the snapping holes 1011 on the rear portion of the top surface 101 of the insulative housing 10. Engage the spur 233 on bottom surface of the second cooperation 23 with the snapping hole 1012 in front of the third slot 1045. As a result, the terminals are fastened.

In addition, the compression portions 216, 225, 234, 246, 254, and 264 on the above terminal assembly all extend out of the bottom surface 104 of the insulative housing 10 to cooperate with the notches 105 on both sides of the bottom surface 104 so as to electrically connect to the PCB. As an end, signal can be communicated therethrough.

While the invention herein disclosed has been described by means of specific embodiments, numerous modifications and variations could be made thereto by those skilled in the art without departing from the scope and spirit of the invention set forth in the claims.

What is claimed is:

1. An audio receptacle connector comprising:

an insulative housing of being substantially parallelepiped comprising a body portion, a mating portion extended along an axis of the body portion, an insertion hole disposed on the mating portion, a plurality of terminal grooves on a bottom surface of the body portion, and a plurality of slots on a rear of the terminal grooves; and a terminal assembly comprising a plurality of pairs of terminals, a grounding terminal, and a receiving terminal;

wherein solder legs of the terminal assembly are flexibly compressible, wherein each terminal has a compression portion bent and extended outward from a bottom of the terminal, and wherein a contact portion is formed at an end of the compression portion for contacting a PCB, wherein the terminal assembly comprises a first flexible terminal, a first cooperation terminal, a second flexible terminal, a second cooperation terminal, a grounding terminal, and a receiving terminal, and wherein the grounding terminal is placed in the first terminal groove in a front end of the insulative housing, the receiving terminal is placed in the second terminal groove in the front end of the insulative housing, the first flexible terminal and first cooperation terminal are placed in the first slot and second slot respectively, and the second flexible terminal and second cooperation terminal are placed in the third slot and fourth slot respectively.

2. An audio receptacle connector comprising:

an insulative housing of being substantially parallelepiped comprising a body portion, a mating portion extended along an axis of the body portion, an insertion hole disposed on the mating portion, a plurality of terminal grooves on a bottom surface of the body portion, and a plurality of slots on a rear of the terminal grooves; and a terminal assembly comprising a plurality of pairs of terminals, a grounding terminal, and a receiving terminal;

wherein solder legs of the terminal assembly are flexibly compressible, wherein each terminal has a compression portion bent and extended outward from a bottom of the terminal, and wherein a contact portion is formed at an end of the compression portion for contacting a PCB, wherein the terminal assembly comprises a first flexible terminal, a first cooperation terminal, a second flexible terminal, a second cooperation terminal, a grounding terminal, and a receiving terminal, and wherein the first cooperation terminal is bent, a straight portion thereof is formed as a snapping portion, and a lateral portion thereof is formed as a stop member having a concave hole.

* * * * *